United States Patent [19]

Lax et al.

[11] Patent Number: 4,819,840

[45] Date of Patent: Apr. 11, 1989

[54] REFRACTORY SUBMERGED POURING NOZZLE

[75] Inventors: Hermann Lax, Düsseldorf; Karl-Ulrich Köhler, Neukirchen-Vluyn, both of Fed. Rep. of Germany

[73] Assignee: Thyssen Stahl Aktiengesellschaft, Duisburg, Fed. Rep. of Germany

[21] Appl. No.: 72,088

[22] Filed: Jul. 10, 1987

[30] Foreign Application Priority Data

Jul. 12, 1986 [DE] Fed. Rep. of Germany ..... 3623660

[51] Int. Cl.[4] ..... B22D 11/10

[52] U.S. Cl. ..... 222/606; 164/337; 164/437

[58] Field of Search ..... 222/606, 607, 591; 164/337, 437

[56] References Cited

U.S. PATENT DOCUMENTS

| | | | |
|---|---|---|---|
| 3,459,346 | 8/1969 | Tinnes | 222/606 X |
| 3,587,719 | 6/1971 | Schreue | 164/337 X |
| 3,648,761 | 3/1972 | Speith et al. | 164/437 |
| 3,669,181 | 6/1972 | Sohrewe | 164/437 |
| 3,995,682 | 12/1976 | Fekete et al. | 222/591 X |
| 4,487,251 | 12/1984 | Cahoon et al. | 164/437 X |
| 4,662,546 | 5/1987 | Mosser et al. | 222/591 |
| 4,671,433 | 6/1987 | Podrini et al. | 222/606 |

FOREIGN PATENT DOCUMENTS

| | | | |
|---|---|---|---|
| 23558 | 2/1986 | Japan | 164/437 |

*Primary Examiner*—Joseph J. Rolla
*Assistant Examiner*—Nils E. Pedersen
*Attorney, Agent, or Firm*—Sprung Horn Kramer & Woods

[57] ABSTRACT

The invention relates to a refractory submerged pouring nozzle for the continuous casting of molten metals, especially molten steel, in a mould for thin slabs. The submerged pouring nozzle 2 is covered by a bottom plate 13 on its lower end face and has two opposing outflow orifices 11. While the edge of the bottom 13 forms a breakaway edge 11' for the molten metal, there adjoins the remaining edge of the especially archway-like outflow orifice 11 a roof-shaped guide element 15, the sideparts 15' of which have free edges 15" projecting from the outer edge of the upper part 15" of the guide element 15 and extending obliquely downwards to the lower breakaway edge 11'.

12 Claims, 2 Drawing Sheets

REFRACTORY SUBMERGED POURING NOZZLE

BACKGROUND OF THE INVENTION

The invention relates to a refractory submerged pouring nozzle for the continuous casting of molten metals, especially liquid steel, into thin slabs in a mould which is funnel shaped preferably in the centre in the upper region, with outflow orifices which are located opposite one another laterally in the nozzle wall in front of a closed bottom and which face the narrow sides of the mould.

Such a known submerged pouring nozzle ("Stahleisen-Schriften", No. 8, "The continuous casting of steel", page 21) is more advantageous in comparison with a pouring nozzle open at the bottom, because a turbulence detrimental to solidification can be prevented in the mould by dividing and deflecting the nozzle jet. A disadvantage, however, is that, during the filling of the mould, metal splashes up onto the upper regions of the mould wall and cakes on them, as a result of which the formation of a casting shell can be impeded and breakout caused. Furthermore, the molten metal is not distributed to the best possible effect. Too little molten metal reaches the upper regions in particular, so that a temperature drop towards these regions occurs. This produces an uneven solidification over the cross-section of the strand to be cast.

Although distributor pipes inserted in the outflow orifices can be used to bring molten metal even into regions of the mould further away from the pouring nozzle (German Patent Specification No. 2,250,048), nevertheless there is then, in the immediate vicinity of the submerged pouring nozzle, a region which molten metal cannot reach directly from the submerged pouring nozzle.

SUMMARY OF THE INVENTION

The object on which the invention is based is to provide a submerged pouring nozzle of the type mentioned in the introduction, in which metal does not splash up and cake on the cooled mould wall at the start of casting and, during normal casting operation, the molten metal is distributed over the cross-section of the mould more effectively than with known submerged pouring nozzles.

According to the invention, this object is achieved because the outflow orifices each have, in the upper region, a roof-shaped guide element projecting from the nozzle wall and, in the lower region, a breakaway edge formed by the bottom and/or the nozzle wall.

During filling, the guide element prevents molten metal from splashing up onto the upper regions of the cooled mould wall and caking on there. When the mould is filled, the guide element ensures that molten metal reaches even the upper regions on the narrow sides of the mould wall so that no zone of lower temperature occurs here. But because of the breakaway edge in the lower region, molten metal also passes directly into the region below the submerged pouring nozzle, so that, as a result, the molten metal is distributed uniformly over the entire cross-section of the mould.

According to an embodiment of the invention, the uniform distribution of the molten metal and consequently also a uniform temperature distribution over the cross-section of the mould can be assisted if each roof-shaped guide element extends to the lower breakaway edge on both sides of each outflow orifice. At the same time, in an especially advantageous embodiment, the distance of the free edge of the lateral parts of the guide element from the nozzle wall decreases especially continuously from the upper region of the guide element to the breakaway edge provided in the lower region of the outflow orifice.

In an appropriate design, each breakaway edge lies in a plane extending perpendicularly to the nozzle axis. The outflow orifices should be made archway-like in the upper region. The guide element itself is preferably matched to the shape of the associated outflow orifice.

The uniform distribution of the molten metal can be improved even further if the clear width of each outflow orifice increase from the upper region towards the breakaway edge. The breakaway edge should extend over the entire clear width of the nozzle.

To ensure that molten metal can better reach the upper regions on the narrow sides of the mould, according to an embodiment of the invention the part of the guide element located above the outflow orifice forms an acute angle with the part of the nozzle wall located above it. An angle greater than 70° has proved expedient.

It is favourable in flow terms if the bottom is curved upwards towards the nozzle interior in the centre, to form guide surfaces descending to the outflow orifices.

According to further embodiments, the clear width of the outflow orifices is at most equal to the distance between the wide sidewalls of the moulds in its lower region determining the casting format.

So that sufficient molten metal can be introduced into the mould where moulds intended for wide thin slabs are concerned, the submerged pouring nozzle can have an oval cross-section, as is known per se. In this case, the outflow orifices are provided in the wall regions having the smaller radius of curvature.

The invention is explained in detail below with reference to a drawing illustrating an exemplary embodiment. In particular, in the drawing:

DETAILED DESCRIPTION OF THE INVENTION

Figure 2:
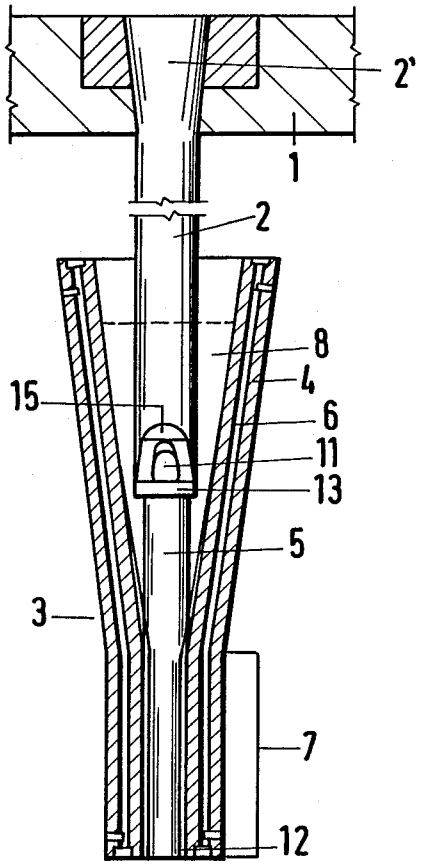
FIG. 2 shows the mould according to FIG. 1 in a longitudinal section through the wide side walls of the mould.
Figure 1:
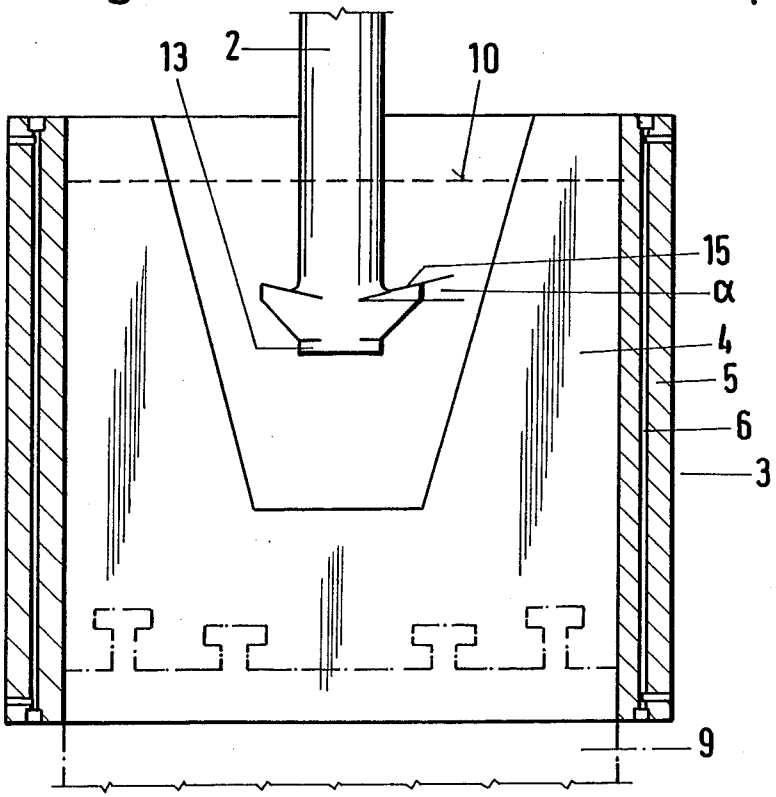
FIG. 1 shows a mould for the continuous casting of a thin slab by means of a submerged pouring nozzle in a longitudinal section through the narrow side walls of the mould.
Figure 3:
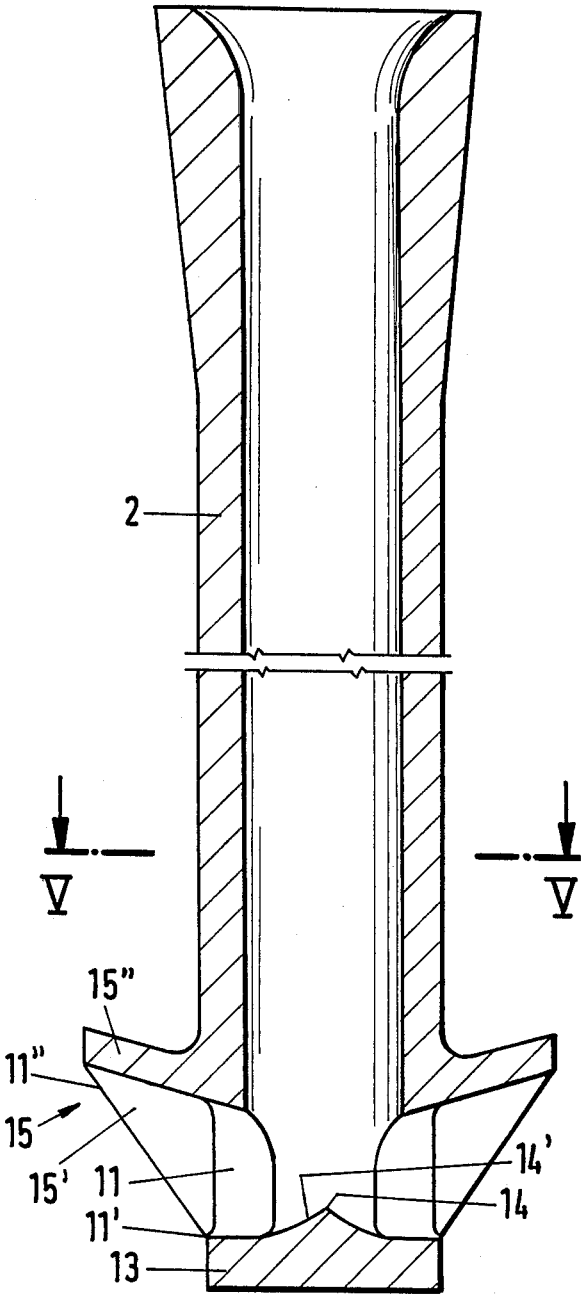
FIG. 3 shows the submerged pouring nozzle of FIG. 1 in axial section.
Figure 5:
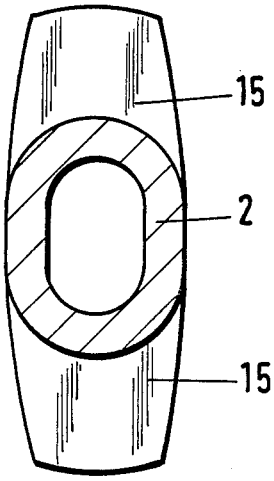
FIG. 5 shows a cross-section through the submerged pouring nozzle according to FIG. 3 along the line V—V of FIG. 3.
Figure 4:
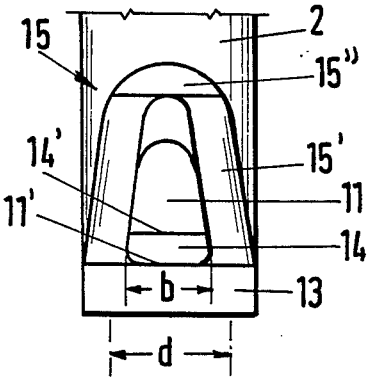
FIG. 4 shows a part view of the submerged pouring nozzle according to FIG. 3 in the direction of an outflow orifice.

Referring to FIG. 1, a submerged pouring nozzle 2 with a conical head piece 2' is held in the floor of a tundish 1 for liquid metal. The lower end of the submerged pouring nozzle 2 projects into a mould 3 for the casting of thin slabs of a size of preferably 20–100 mm. The mould 3 is formed by two opposing wide sidewalls 4 and two opposing narrow sidewalls 5. The wide sidewalls 4 and the narrow sidewalls 5 are equipped with cooling ducts 6. The wide sidewalls 4 form in the centre, above a parallel portion 7 determining the format of the strand, a pouring-in region 8 which widens upwards in the form of a funnel and which is intended for receiving the lower end of the submerged pouring nozzle 2.

The submerged pouring nozzle 2 has an oval throughflow cross-section and is closed off on its lower end face by means of a bottom plate 13. Immediately above the bottom plate 13 in the wall having the smaller radius of curvature archway-like outflow orifices 11 are arranged on opposite sides. The lower edge 11' of the outflow orifice 11 formed by the bottom plate 13 lies in a plane perpendicular to the axis of the submerged pouring nozzle 2 and acts as a breakaway edge. The maximum width b of the outflow orifice 11 at the breakaway 11' is equal to or less than the clear distance d between the wide sidewalls 4 of the mould 3 in the parallel portion 7 determining the format of the cast-strand. The inner face of the bottom plate 13 is curved arcuately upwards towards the interior of the submerged pouring nozzle 2, to form a vertex 14. Guide surfaces 14' descend arcuately from the vertex 14 of this curved-up portion to the breakaway edges 11'.

A roof-shaped guide element 15 adjoins the laterial edges and the top edge of the archway-like outflow orifice 11. The free edges 15'' of the side parts 15' of this roof-shaped guide element 15 are bevelled from the upper part 15'' furthest away from the nozzle wall to the breakaway edge 11' in the lower region of the outflow orifice 11. The upper part 15'' of the roof-shaped guide element 15 is directed obliquely upwards and forms an acute angle of more than $90° - \alpha = 70°$ with the axis of the submerged pouring nozzle.

At the start of casting, the molten metal flowing into the submerged pouring nozzle 2 is divided by the vertex 14 and the guide surface 14' of the curved-up portion of the bottom plate 13 and passes out through the outflow orifices 11. Since, at this stage, the mould is not yet filled with the flow-damping molten metal, the guide element 15 prevents the metal from splashing upwards and to the sides and caking on the cooled wide sidewalls 4 and narrow sidewalls 5. The molten metal flowing out into the mould 3 solidifies on the wall of the mould 3 and joins with a dummy bar 9 closing the mould 3 at the bottom. As soon as the ascending pouring level 10 rises above the lateral orifices 11, it is covered with casting powder. The steel solidifies on the cooled wide sidewalls 4 and narrow sidewalls 5, to form slab shells 12, the thickness of which increases continuously downwards. By means of the breakaway edge 11' formed by the bottom plate 13, the molten metal flowing out of the outflow orifices 11 can flow directly downwards. The side parts of each guide element 15 prevent the molten metal from flowing directly towards the near wide sidewalls 4 and, together with the upper part 15'' drawn far forwards, ensure that the stream of molten metal is guided into the upper regions located near the narrow sidewalls 5. All together, the best possible distribution of the molten metal to the lateral regions during normal casting is ensured in this way, whilst at the start of casting molten metal is prevented from splashing and caking on the cooled sidewalls. This means that the slab shells 12 can solidify uniformly over the entire periphery. Finally, because the flow of molten metal is guided upwards in a special way, it becomes possible to eliminate inclusions in the melt towards the pouring level 10.

We claim:

1. In a submerged pouring nozzle for the continuous casting of molten metals into thin slabs in a mold having narrow sides and wide sides and an upper region which is funnel shaped, wherein the nozzle has a closed bottom and means forming outflow orifices disposed opposite each other laterally in a nozzle wall upstream of the bottom and facing the narrow sides of the mold, the improvement wherein the means forming the outflow orifice comprises for each orifice a guide element projecting radially outwardly and upwardly from an outside surface of the nozzle wall at an upper region of the orifice and at an acute angle to the nozzle wall and means forming a breakaway edge at a lower region of the orifice comprising at least one of the nozzle wall and the bottom.

2. The submerged pouring nozzle according to claim 1, wherein each guide element has, at sides of each outflow orifice, lateral parts extending to the breakaway edge.

3. The submerged pouring nozzle according to claim 2, wherein the lateral parts have free edges and the distance of the free edges of the lateral parts of the guide element from the nozzle wall decreases from the upper region of the orifice to the breakaway edge located in the lower region of the orifice.

4. The submerged pouring nozzle according to claim 1, wherein the nozzle has a longitudinal axis and each breakaway edge is in a plane extending perpendicularly to the nozzle axis.

5. The submerged pouring nozzle according to claim 1, wherein the outflow orifices are arcuate in the upper region thereof.

6. The submerged pouring nozzle according to claim 1, wherein each guide element is matched to the shape of its associated outflow orifice.

7. The submerged pouring nozzle according to claim 1, wherein the width of each outflow orifice increases from the upper region thereof towards the breakaway edge.

8. The submerged pouring nozzle according to claim 1, wherein the breakaway edge extends over the width of each orifice.

9. The submerged pouring nozzle according to claim 1, wherein the acute angle is greater than 70°.

10. The submerged pouring nozzle according to claim 1, wherein the bottom is curved upwards towards the nozzle interior in a central portion to form guide surfaces descending to the outflow orifices.

11. The submerged pouring nozzle according to claim 1, wherein the width of each outflow orifice is at most equal to the distance between the wide sides of the mould at a lower region of the mould to define the form of the caststrand.

12. The submerged pouring nozzle according to claim 1, wherein the pouring nozzle has an oval cross-section, and the outflow orifices are located in a wall region having a smaller radius of curvature than the oval cross-section.

* * * * *